United States Patent [19]

Silber

[11] 4,372,320

[45] Feb. 8, 1983

[54] ARTICLE OF CLOTHING HAVING BUILT-IN BUST SUPPORT

[76] Inventor: Philip Silber, 3 Guyer Rd., Westport, Conn. 06880

[21] Appl. No.: 296,705

[22] Filed: Aug. 27, 1981

[51] Int. Cl.[3] ..... A41C 3/08; A41B 5/00

[52] U.S. Cl. ..... 128/455; 2/67

[58] Field of Search ..... 128/455, 454, 431; 2/67, 105

[56] References Cited

U.S. PATENT DOCUMENTS

| | | | |
|---|---|---|---|
| 1,164,642 | 12/1915 | Guinzburg | 128/254 |
| 1,587,672 | 6/1926 | Nightinggale | 128/454 |
| 2,009,620 | 7/1935 | Jackson | 128/454 |
| 2,341,037 | 2/1944 | Freed et al. | 2/67 |
| 3,392,730 | 7/1968 | Relli | 128/454 |

FOREIGN PATENT DOCUMENTS

| | | | |
|---|---|---|---|
| 1342315 | 9/1963 | France | 2/67 |

*Primary Examiner*—Doris L. Troutman

*Attorney, Agent, or Firm*—Alan H. Levine

[57] ABSTRACT

An article of clothing comprising an outer garment and an inner garment having an upper part and a lower part. The upper part of the inner garment is capable of extending from above the bust of a person wearing the article of clothing to below the bust of the person and the lower part, which is preferably elastic, is capable of being placed below the bust. The upper part is attached to the outer garment, and the lower part is attached to the bottom of the upper part.

5 Claims, 4 Drawing Figures

ARTICLE OF CLOTHING HAVING BUILT-IN BUST SUPPORT

BACKGROUND OF THE INVENTION

In very warm weather, it is the usual practice for some women to wear the minimum amount of clothing, in order to keep cool, while at the same time presenting the proper appearance in public. Sometimes a women chooses to wear as a top, an article of clothing that not only is sleeveless but also has very thin shoulder straps.

Thin shoulder straps present a problem in that they do not effectively conceal the usually wider bra straps, if a bra is worn beneath this top. To overcome this difficulty, some women choose to omit the wearing of a bra under such a top. Other women, for whom it is necessary to wear a bra, may decide instead to wear a strapless bra. However a strapless bra is, very frequently, rather uncomfortable to wear in warm weather.

OBJECTS OF THE INVENTION

It is an object of the present invention to provide an article of clothing having a built-in bust support which enables the article to function in part as a bra, even though no separate bra, either strapless or with straps, is being worn.

It is another object of the present invention to provide an article of clothing having a built-in bust support which is automatically adjustable to accommodate different wearers of various chest sizes and shapes.

It is an additional object of the present invention to provide an article of clothing comprising an outer garment, an inner garment having an upper part and a lower part, the upper part being capable of extending from above the bust of a person wearing the article of clothing to below the bust of the person, means for attaching the upper part to the outer garment, the lower, preferably elastic, part being capable of being placed below the bust of the wearer, and means for attaching the lower part to the bottom of the upper part.

These and further objects of the present invention will become more apparent as the description thereof proceeds.

THE DRAWINGS

The present invention will also be described by reference to the following drawings, which are not to be deemed limitative of the invention in any manner whatsoever.

DESCRIPTION OF THE INVENTION

The present invention relates to an article of clothing having built-in bust support which enables the article to function in part as a bra, even though no separate bra, either strapless or with straps, is being worn.

Figure 1:
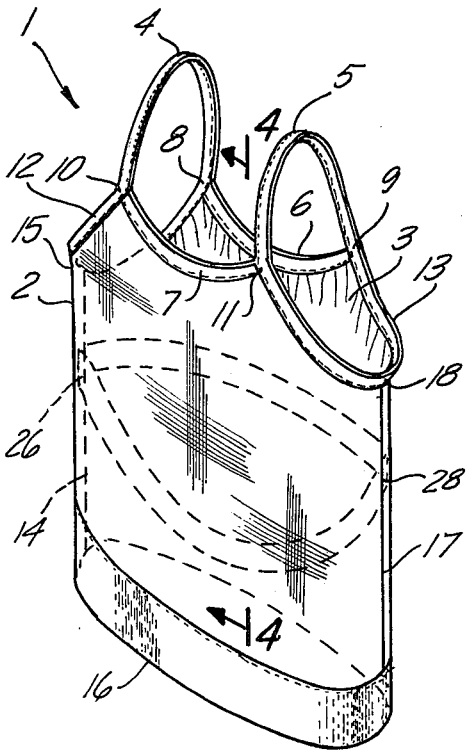
FIG. 1 is a perspective view, from the back, of an article of clothing having a built-in bust support.

Referring now to the drawings, FIG. 1 is a perspective view, from the back, of the article of clothing 1 having built-in bust support. This article of clothing, intended to be worn by a physically mature female, comprises an outer garment 2 and an inner garment 3.

Outer garment 2 is shown here as a camisole-type top, which is the preferred embodiment. However the outer garment 2 could be any other top, as long as it is capable of extending from the shoulders of the person wearing it to the waist of the person.

Outer garment 2 includes a thin shoulder strap 4 for fitting over the left shoulder of the wearer and a thin shoulder strap 5 for fitting over the right shoulder of the wearer. Between shoulder straps 4 and 5 are front and back fabric reinforcement ribs 6 and 7.

Front rib 6 is located on the front side of outer garment 2 and extends between a left junction point 8 and a right junction point 9 on the front side of the outer garment. Back rib 7 is located on the back side of outer garment 2 and extends between a left junction point 10 and a right junction point 11 on the back side of the outer garment. Thus it can be seen that the thin shoulder strap 4 extends above and between junction points 8 and 10 on the left side of the outer garment, while the thin shoulder strap 5 extends above and between junction points 9 and 11 on the right side of the outer garment 2.

Extending below and between junction points 8 and 10 is a left side fabric reinforcement rib 12. Extending below and between junction points 9 and 11 is a right side fabric reinforcement rib 13.

Generally speaking, the shoulder straps in combination with the various fabric reinforcement ribs are constructed and arranged in such a manner that they coact with the inner garment and assist in providing the bust support which is built into the article of clothing. These fabric reinforcement ribs help to absorb the stresses and help to distribute the load generated by the size, shape and weight of the breasts which are to be supported within the article of clothing.

Located at approximately half the distance below and between junction points 8 and 10 is a left side longitudinal seam line 14, which extends from the approximate midpoint 15 of rib 12 down to the bottom 16 of the outer garment. Located at approximately half the distance below and between junction points 9 and 11 is the right side longitudinal seam line 17, which extends from the approximate midpoint 18 of rib 13 down to the bottom 16 of the outer garment.

Figure 2:
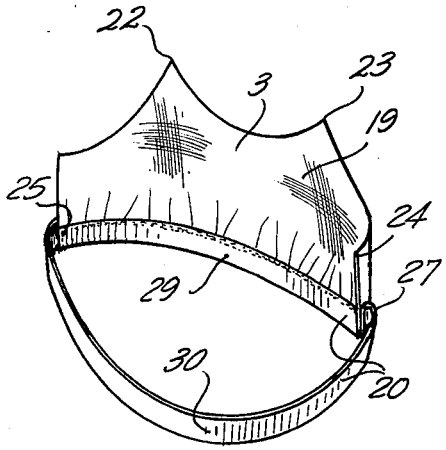
FIG. 2 is a perspective view of the bust support inner garment apart from the outer garment of the article of clothing.

FIG. 2 is a perspective view of the bust support inner garment 3 apart from the outer garment 2. Inner garment 3 is located inside of the outer garment 2 and has an upper part 19 and a lower part 20.

Upper part 19 of the inner garment 3 is capable of extending from above the bust of a person wearing the article of clothing to below the bust of this person. The upper part extends along the inner front side of the outer garment, as will now be discussed.

The upper part 19 of the inner garment is securely attached to the outer garment 2 as follows (see FIGS. 1–3): corner 21 of the upper part is aligned with the approximate midpoint 15 of the left side fabric reinforcement rib 12; corner 22 of the upper part is aligned with junction point 8; corner 23 of the upper part is aligned with junction point 9; and corner 24 of the upper part is aligned with the approximate midpoint 18 of the right side fabric reinforcement rib 13. The edge which runs between corners 21 and 22 of the upper part is placed in juxtaposition to the edge which runs between midpoint 15 and junction point 8 of the outer garment. The edge which runs between corners 22 and 23 of the upper part is placed in juxtaposition to the edge which runs between junction points 8 and 9 of the outer garment. The edge which runs between corners 23 and 24 of the upper part is placed in juxtaposition to the edge which runs between junction point 9 and midpoint 18. This juxtaposition creates a series of layered edges between the inner garment and the outer garment.

Overlay fabric material, which may be similar to that material of which the outer garment 2 is made, is then folded over the series of layered edges of the inner and outer garments. These layered garment edges are pressed together very tightly between the folded over overlay fabric material. Then this combination of layers is stitched together very tightly and securely to produce the laminated perimeters, or the fabric reinforcement ribs, discussed above, and which extend between midpoint 15 and junction point 8, between junction points 8 and 9, and between junction point 9 and midpoint 18. These fabric reinforcement ribs, or laminated perimeters, constitute means for securely attaching the upper part of the inner garment to the outer garment along the front side of the outer garment.

In order to provide the further necessary fabric reinforcement for the article of clothing, more of the same overlay fabric material is then folded over the edges of the outer garment that extend between approximate midpoint 15 and junction point 10, between junction points 10 and 11, and between junction point 11 and approximate midpoint 18. Each garment edge is pressed very tightly between the folded over overlay fabric material. Then this combination of layers is stitched together very tightly and securely to produce the laminated perimeters which extend between midpoint 15 and junction point 10, between junction points 10 and 11, and between junction point 11 and midpoint 18.

Thin shoulder straps 4 and 5 are constructed from the same overlay fabric material, which is folded back upon itself and stitched together very tightly and securely. The shoulder straps, as shown in FIG. 1, may be made from a part of a unitary piece of reinforcement fabric, which extends continuously from up, around and over the shoulder to down, around and under the arm of the person wearing the article of clothing.

Corner 25 of the upper part of the inner garment is aligned with attachment zone 26 which is located within and along the left side longitudinal seam line 14. Corner 27 of the upper part of the inner garment is aligned with attachment zone 28 which is located within and along the right side longitudinal seam line 17.

The left edge of the upper part between corners 21 and 25 is stitched very tightly to the left side seam line 14 between midpoint 15 and attachment zone 26. This constitutes means for securely attaching the upper part of the inner garment to the outer garment along the left side of the outer garment. The right edge of the upper part between corners 24 and 27 is stitched very tightly to the right side seam line 17 between midpoint 18 and attachment zone 28. This constitutes means for securely attaching the upper part of the inner garment to the outer garment along the right side of the outer garment. Taken together, all of these specific attachment means are included within the generic means for securely attaching the upper part of the inner garment to the outer garment.

The lower part 20 of the inner garment extends circumferentially completely around the inside of the outer garment. The lower part is also capable of being placed below the bust of a person wearing the article of clothing.

Lower part 20 comprises front section 29 and rear section 30. Front section 29 is that portion of the lower part 20 which is securely attached, by attachment means such as by a double row of stitching, to the bottom edge of the upper part 19 of the inner garment 3. Front section 29 is connected at left corner 25 to the bottom edge of the upper part 19 of the inner garment 3. Front section 29 is connected at left corner 25 to the bottom edge of the upper part 19 of the inner garment 3 and simultaneously is connected at attachment zone 26 to the left side longitudinal seam 14 of the outer garment 2. This simultaneous connection constitutes means for securely attaching the lower part of the inner garment to the left side of the outer garment.

Front section 29 is connected at right corner 27 to the bottom edge of the upper part 19 of the inner garment 3 and simultaneously is connected at attachment zone 28 to the right side longitudinal seam 17 of the outer garment 2. This simultaneous connection constitutes means for securely attaching the lower part of the inner garment to the right side of the outer garment.

Between corners 25 and 27, the front section 29 is continuously attached to the bottom edge of the upper part 19 of the inner garment. However, between corners 25 and 27, the front section of the lower part is not attached to the outer garment 2, and between corners 25 and 27, the bottom edge of the upper part 19 is also not attached to the outer garment.

Rear section 30 is that portion of the lower part 20 which is not attached to the bottom edge of the upper part 19, except at corners 25 and 27. Rear section 30 is also not attached to the outer garment 2, except at corners 25 and 27. Thus rear section 30 hangs suspended in air and is capable of moving freely within the inside of the outer garment.

Figure 3:
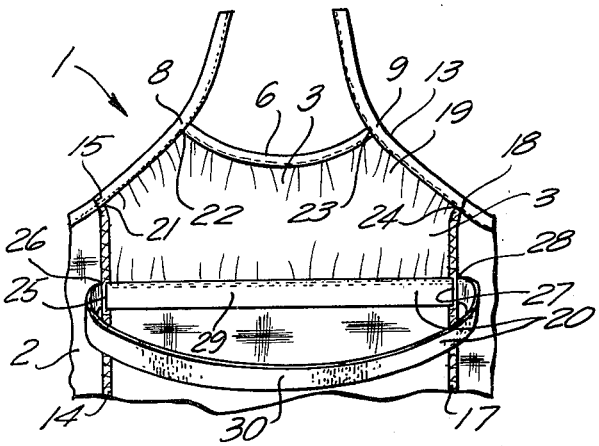
FIG. 3 is a rear view of the article of clothing with the back portion of the outer garment removed.

FIG. 3 is a rear view of the article of clothing 1 with the back portion of the outer garment 2 removed. This figure in part shows how the upper part 19 of the inner garment is securely attached to the outer garment. It can be seen that at corner 25 the front section 29 is securely attached to the attachment zone 26 of the left side seam line 14. At corner 25, rear section 30 is also securely attached to the attachment zone 26 of the seam line 14. At corner 27 the front section 29 is securely attached to the attachment zone 28 of the right side seam line 17. At corner 27, rear section 30 is also securely attached to the attachment zone 28 of the seam line 17. Between corners 25 and 27, the remainder of the rear section 30 is not attached to any part of either the inner garment or the outer garment.

Figure 4:
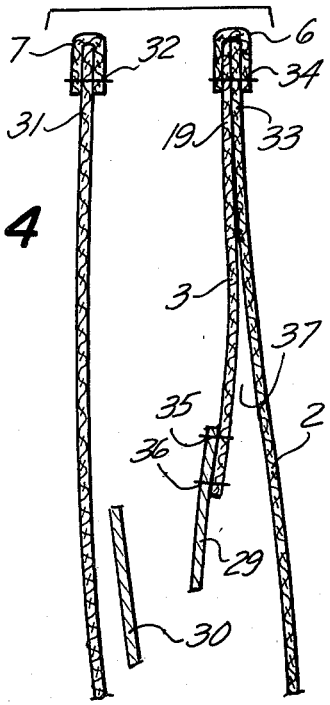
FIG. 4 is a cross-sectional view taken along section line 4—4 of FIG. 1.

FIG. 4 is a section view along section line 4—4 of FIG. 1. Back reinforcement rib 7 is constructed from overlay fabric material which is folded over the upper edge of back side 31 of the outer garment 2 and which is securely attached thereto by stitching 32. Front reinforcement rib 6 is constructed from overlay fabric material, which is folded over the layered upper edges of upper part 19 of the inner garment and of front side 33 of the outer garment. This fabric material is securely attached to these layered upper edges by stitching 34. Between back side 31 and front side 33 of the outer garment are shown the component parts of the inner garment, namely upper part 19, front section 29 of the lower part and rear section 30 of the lower part. Front section 29 is securely attached to the bottom edge portion of the upper part 19 by double rows of stitching 35 and 36. Rear section 30 is located between front section 29 and back side 31. In region 37, upper part 19 of the inner garment and the front side 33 of the outer garment are unconnected.

The outer garment is preferably made from fabric material that is soft, light-weight, and cool in hot weather, such as a blend of cotton and polyester. However, other fabrics can obviously be used.

The inner garment upper part is preferably made from a fabric material that is soft, light-weight, strong, preferably stretchable, and cool in hot weather, such as nylon or polyester. The inner garment lower part is made from a fabric material that is strong and stretchable, such as an elastic band.

An article of clothing having built-in bust support according to the invention would be worn over the upper torso of the wearer, such that the upper part 19 of the inner garment 3 extends from above the bust of the wearer to below the bust of the wearer and along the inner front side of the outer garment. The front section 29 of the lower part of the inner garment is placed below the bust of the wearer. The rear section 30 of the lower part of the inner garment is located around the back of the wearer. The elastic nature of sections 29 and 30 maintain the inner garment in place below the bust, while the upper part 19 of the inner garment supports the bust in somewhat the way that a halter top supports the bust.

The present invention has the following advantages. The article of clothing has very narrow shoulder straps 4 and 5, and, provides bust support for the female wearer, this support being built right into the garment itself, so that no bra straps are seen and a strapless bra need not be worn. This built-in bust support is located in the interior of the garment at the upper front portion thereof. Thus the built-in bust support enables the article to function in part as a bra, even though no separate bra, either strapless or with straps, is being worn. The article of clothing has the further advantage that the built-in bust support is stretchable to accommodate various chest sizes and shapes. Thus the article of clothing can be worn comfortably over long periods of time by female wearers of different ages, sizes, and shapes. The article of clothing according to the invention achieves its desired results because the inner garment, which envelopes and supportingly upholds the bust of the wearer, is itself securely attached to the outer garment which strengthens the load carrying capability thereof.

Although the present invention has been disclosed in connection with a few preferred embodiments thereof, variations and modifications may be resorted to by those skilled in the art without departing from the principles of the new invention. All of these variations and modifications are considered to be within the true spirit and scope of the present invention as disclosed in the foregoing description and defined by the appended claims.

What is claimed is:

1. An article of clothing having built-in bust support and being capable of being worn by a person comprising an outer garment which is capable of extending from the shoulders of said person to the waist of said person, said outer garment having a right side longitudinal seam line and a left side longitudinal seam line, a right side attachment zone located within and along said right side longitudinal seam line, a left side attachment zone located within and along said left side longitudinal seam line, an inner garment inside of said outer garment and having an upper part and a lower part, said upper part of said inner garment being capable of extending from above the bust of said person to below the bust of said person and along the inner front side of said outer garment, means for securely attaching said upper part of said inner garment to said outer garment along the front side of said outer garment, means for securely attaching said upper part of said inner garment to said outer garment, along the right side longitudinal seam line of said outer garment, from above said right side attachment zone, down to and within, said right side attachment zone, means for securely attaching said upper part of said inner garment to said outer garment along the left side longitudinal seam line of said outer garment, from above said left side attachment zone, down to and within, said left side attachment zone, said lower part of said inner garment extending circumferentially completely around the inside of said outer garment and said lower part being capable of being placed below the bust of said person, said lower part of said inner garment comprising a front section and a rear section, means for securely attaching said front section of said lower part of said inner garment to the bottom edge of said upper part of said inner garment, means for securely attaching said front section of said lower part of said inner garment at said right side attachment zone to the right side longitudinal seam line of said outer garment, means for securely attaching said front section of said lower part of said inner garment at said left side attachment zone to the left side longitudinal seam line of said outer garment, between said right side attachment zone and said left side attachment zone said front section of said lower part of said inner garment is continuously attached to said bottom edge of said upper part of said inner garment, and between said attachment zones said front section of said lower part of said inner garment is not attached to said outer garment, and between said attachment zones said bottom edge of said upper part is also not attached to said outer garment, whereby there is a region in which said upper part of said inner garment and the front side of said outer garment are unconnected.

2. The article of clothing of claim 1, wherein said lower part of said inner garment includes an elastic material making said lower part stretchable in a generally horizontal direction when the article of clothing is worn.

3. The article of clothing of claim 1, wherein said outer garment is a camisole-type top.

4. The article of clothing of claim 1, wherein said rear section of said lower part is that portion of said lower part which is not attached to said bottom edge of said upper part except at said right side attachment zone and at said left side attachment zone, wherein said rear section is also not attached to said outer garment except at said right side attachment zone and at said left side attachment zone, and wherein said rear section thus hangs suspended in air and is capable of moving freely within the inside of said outer garment.

5. The article of clothing of claim 1, wherein said outer garment further comprises a thin right shoulder strap for fitting over the right shoulder of said person, a thin left shoulder strap for fitting over the left shoulder of said person, a front fabric reinforcement rib located on the front side of said outer garment between said right shoulder strap and said left shoulder strap, said front rib joining said right strap at a front right junction point and said front rib joining said left strap at a front left junction point, a back fabric reinforcement rib located on the back side of said outer garment between said right shoulder strap and said left shoulder strap, said back rib joining said right strap at a back right junction point and said back rib joining said left strap at a back left junction point, a right side fabric reinforcement rib extending below and between said front right junction point and said back right junction point, a left side fabric reinforcement rib extending below and between said front left junction point and said back left junction point, and wherein said front fabric reinforcement rib, said right side fabric reinforcement rib and said left side fabric reinforcement rib constitute said means for securely attaching said upper part of said inner garment to said outer garment along the front side of said outer garment.

* * * * *